US006628199B1

(12) United States Patent
Ehrensvärd et al.

(10) Patent No.: US 6,628,199 B1
(45) Date of Patent: Sep. 30, 2003

(54) INTEGRATED PHARMACEUTICAL PACKAGE AND QUESTIONNAIRE

(75) Inventors: Jakob Ehrensvärd, Täby (SE); Stina Grip, Täby (SE)

(73) Assignee: CyPak AB, Täby (SE)

( * ) Notice: Subject to any disclaimer, the term of this patent is extended or adjusted under 35 U.S.C. 154(b) by 0 days.

(21) Appl. No.: 09/806,063

(22) PCT Filed: Sep. 15, 1999

(86) PCT No.: PCT/SE99/01612

§ 371 (c)(1),
(2), (4) Date: Jul. 23, 2001

(87) PCT Pub. No.: WO00/18350

PCT Pub. Date: Apr. 6, 2000

(30) Foreign Application Priority Data

Sep. 25, 1998 (SE) ..... 9803259

(51) Int. Cl.[7] ..... G08B 13/14

(52) U.S. Cl. ..... 340/568.1; 340/540; 340/545.2; 340/309.4; 340/309.15; 368/10; 368/11; 368/206; 368/531; 221/2; 221/3; 221/15; 235/50 R; 235/50 A; 235/50 B; 235/51; 235/54 R; 235/55 R

(58) Field of Search ..... 340/568.1, 540, 340/545.2, 309.4, 309.15; 368/10, 11, 206, 531; 221/2, 3, 15; 235/50 R, 50 A, 50 B, 51, 54 R, 55 R

(56) References Cited

U.S. PATENT DOCUMENTS 5,871,831 A * 2/1999 Zeiter et al. ..... 446/267
6,107,911 A * 8/2000 Perrone ..... 340/309.15
6,198,383 B1 * 3/2001 Sekura et al. ..... 340/309.4
6,301,196 B1 * 10/2001 Daniel ..... 368/10

FOREIGN PATENT DOCUMENTS

| | | |
|---|---|---|
| DE | 196 52 202 A 1 | 6/1998 |
| WO | 94/07184 | 3/1994 |
| WO | 98/36727 | 8/1998 |

* cited by examiner

*Primary Examiner*—Daniel J. Wu
*Assistant Examiner*—Tai T. Nguyen
(74) *Attorney, Agent, or Firm*—Renner, Otto, Boisselle & Sklar, LLP

(57) ABSTRACT

A response form containing a means of input that on manual influence can switch a conducting electrical circuit connected to an electronic unit (40) incorporated into the response form for registration of the said influence. The present invention provides such a response form at low cost and enables the use of the response form as a patient journal. The patient journal also can be integrated with a pharmaceutical response package. The response package is formed of a disposable material in the form of a sheet (12), and a conducting circuit (26) is printed onto one side (16) of the disposable material. The means of input can consist of circuit makers (30, 32) that are visually marked-on one side of the disposable material and that are arranged to make electrical contact across an interrupted loop (28) of the conducting circuit (26) upon pressing together localized inner surfaces (14, 16) of the disposable material which face each other. The means of input also may consist of circuit breakers that are visually marked on pieces of the disposable material and arranged to cause electrical interruption in a loop of the conducting circuit when these pieces are at least partially removed from the response form.

11 Claims, 2 Drawing Sheets

INTEGRATED PHARMACEUTICAL PACKAGE AND QUESTIONNAIRE

FIELD OF THE INVENTION

The invention relates to a response form containing a means of input that on manual influence is capable of switching an electrical circuit connected to an electronic unit incorporated into the response form for registration of the said influence.

BACKGROUND OF THE INVENTION

Certain pharmaceutical companies have recently started to use electronic patient journals during trials of pharmaceuticals. These are currently based on different types of hand-held computers that are programmed so that questions and answers can be registered at a particular time. Such systems have great advantages, but they also have disadvantages such as a high unit cost, expensive special programming, a short period of operation, limited areas for text and images, sensitivity to rough treatment and being attractive objects for theft.

The main reason that these systems have achieved only limited success is that they are experienced as expensive and complicated to manage. None of these systems can record when the pharmaceutical has been removed from its package, but can only remind the patient with a sound or light signal at the specified time for tablet withdrawal.

It has been established in several studies that a clearly significant fraction of patients during pharmaceutical trials do not take the pharmaceutical according to the prescription. This contributes to a large uncertainty during the statistical evaluation of the effects and side-effects of pharmaceuticals.

The pharmaceutical industry currently uses various methods to measure the compliance of patients—their ability to follow the prescription. The most reliable method is to continuously measure the levels of the substance in the blood and urine. In most cases, this in neither practical nor economically possible. The most usual method is to count the number that has been used and to interview the patient. This method is particularly uncertain in that it is based on the assumption that the substance has been taken in the right way at the right time.

The compliance of patients can also be measured by different types of pharmaceutical package that register the time of withdrawal.

SUMMARY OF THE INVENTION

The aim of the current invention is to provide a response form or a questionnaire of the type specified in the introduction, that can be produced at low cost and used as a patient journal, and that can be integrated with a pharmaceutical package.

The invention achieves this aim by having the special properties that are specified in the following claim 1.

According to an aspect of the invention, the response form is composed of a disposable material in the form of a sheet, with the electric circuit printed onto one side of it. The means of input can consist of a switch or circuit maker visibly marked on one side of the disposable material and arranged to form an electrical connection across an interrupted loop of the conducting circuit when influenced by local pressing together of the sides of the disposable material that face each other. The means of input can also consist of a circuit breaker visibly marked on pieces of the disposable material and arranged to cause electrical interruption in a loop of the conducting circuit when influenced by at least partial removal of the loop from the disposable material.

A completed example of such a response form including printed questions, conducting circuits and circuit makers/circuit breakers can be mass produced at a low cost in graphical printing and paper sheet handling machines. The electronic unit, which may have the form of a telephone card, can be inserted into the response form and connected to the conducting circuit, for example, when issuing the response form, and it may be possible to recycle the electronic unit when the form is returned, by inserting it into a new response form.

If the response form is integrated with a pharmaceutical package that registers withdrawals, for example of a likewise disposable material in the form of a sheet, then both journal notes and compliance data can be stored in an electronic unit common to the form and the package.

BRIEF DESCRIPTION OF THE DRAWINGS

Other special properties and advantages of the invention are made clear by the following detailed description of an embodiment of it, with reference to the attached drawings in which.

DETAILED DESCRIPTION

Figure 1:
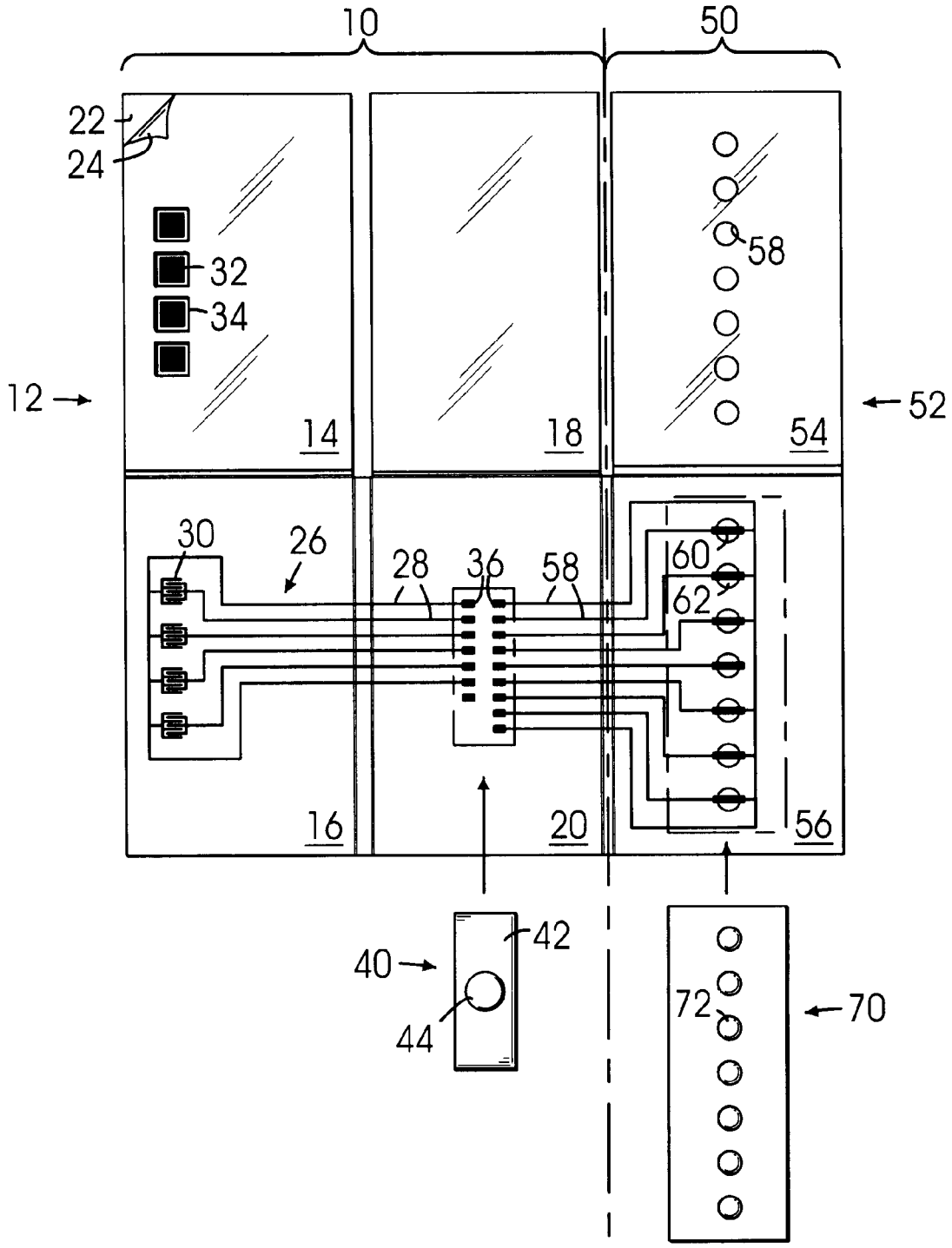
FIG. 1 shows the inside of a response form according to the invention formed in one piece with a pharmaceutical package.
Figure 3:
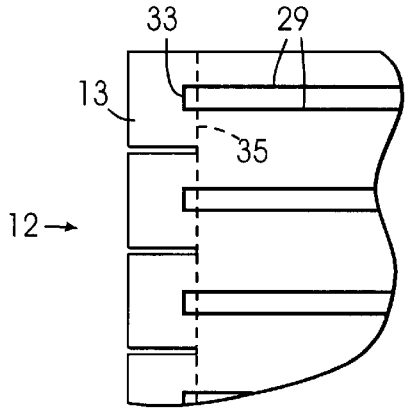
FIG. 3 shows a response form at a larger scale with sections removed and showing alternative means of input.

The examples of a response form 10 according to the invention shown in FIGS. 1 and 3 consist of a disposable material in the form of a sheet 12 on which is printed a conducting circuit 26 to which can be connected an electronic unit 40 that is capable of registering and storing connections and interruptions in loops 28 and 29 of the conducting circuit 26 when this is fed with current from the electronic unit 40.

The conducting circuit 26 preferably consists of an electrically conducting layer that is printed, for example graphically in the form of printing ink or applied by another method, for example in the form of a foil, onto the disposable material 12.

In the response form shown in FIG. 1, the conducting loops 28 are broken at contact points 30. When the form is closed into the condition shown in FIG. 2 by folding or by laying together of separate sheets (not shown) of the disposable material 12, a conducting surface 32 is positioned at a distance above each contact point 30. In this way, a circuit maker is formed that closes the associated loop 28 of the conducting circuit when a user answers a question on the response form by pressing with a finger or pen onto an answer field 31 marked on the form 10 (FIG. 2) so that the conducting surface 32 comes into contact with the contact point 30. As is made clear in FIG. 1, the interrupted ends of the loop 26 are branched and interlocked with each other like the teeth of two combs at the contact points 30, so that a secure connection is made even when only a small region of the conducting surface 32 touches the contact point 30.

When closed and folded, the two inner surfaces 14 and 16 of the disposable material 12 are held at a distance from each other at the contact point 30 by an electrically isolating double-sided tape 24 which is furnished with openings 34 at the contact points 30. A thin cardboard material whose elasticity prevents the insides 14 and 16 accidentally coming into contact with each other at the contact point 30 is suitable to use as disposable material 12. The desired force of contact can naturally be determined by choice of a suitable tape thickness, quality of cardboard and size of the openings 34.

The arrangement of the circuit makers 30, 32 can be varied in many different ways. For example, they can be closely arranged over an area of the response form, so that the user can input answers to those questions that are printed on the form (only one question is shown in FIG. 2) with a pen, and also by drawing lines on a graphical image on the response form (not shown).

In the response form shown in FIG. 3, the conducting loops 29 pass uninterrupted with an end 33 into a circuit breaker in the form of a detachable "reply tab" 13 in the disposable material 12. Each reply tab 13 is marked with reply alternatives in a manner not shown in the figure. When a reply tab 13 is removed at least partially from the disposable material 12 along a perforated detachment line 35, the associated loop 29 will at least partially be removed and broken, so that a signal, preferably periodic to save power, will not return to the electronic unit 40 when outputted into the loop, and in this way it is registered in the electronic unit that the associated reply tab 13 on the form has been torn off. The break in conduction can also be achieved in other ways, such as removal by cutting, clipping or scraping such as for lottery tickets of the scratch card type (not shown).

It is suitable that the electronic unit 40 has approximately the same form as what is known as a mobile telephone card 42 and has a thin button cell battery 44 as a source of power. Several contact points (not shown) on the under surface of the electronic unit 40 make contact with corresponding contact points 36 of the conducting circuit 26 by means of an electrically conducting tape (not shown) when the electronic unit is attached by pressing onto the associated flap section 20 of the disposable material 12. The electronic unit 40 is enclosed in the response form 10 by folding over flap section 18 which is stuck to flap section 20 by means of the double-sided tape 24. Memory circuits are included in the electronic unit 40 that in a known manner are capable of storing timing points and the response alternative that was chosen when the user inputs an answer to the response form 10 in one of the ways described above. In this case, it is suitable that the electronic unit should be a low-price type that is not used in a new response form. However, the electronic unit can also be of such a type that it is removable from the response form in order to be inserted into a new response form after it has been returned. The electronic unit 40 is preferably equipped with a transmitter for transfer of the information that is stored in it to a computer once the response form has been returned after use. Transfer can take place by known methods, such as a cable, infra-red light, etc. If the transmitter is a radio transmitter (not shown), the conducting circuit 26 can also be used as a transmitter aerial. It is also suitable that the electronic unit 40 is equipped with a sound source (not shown) that can confirm the input of an answer by a peeping sound, or remind the user to, for example, take the medicine.

Figure 2:
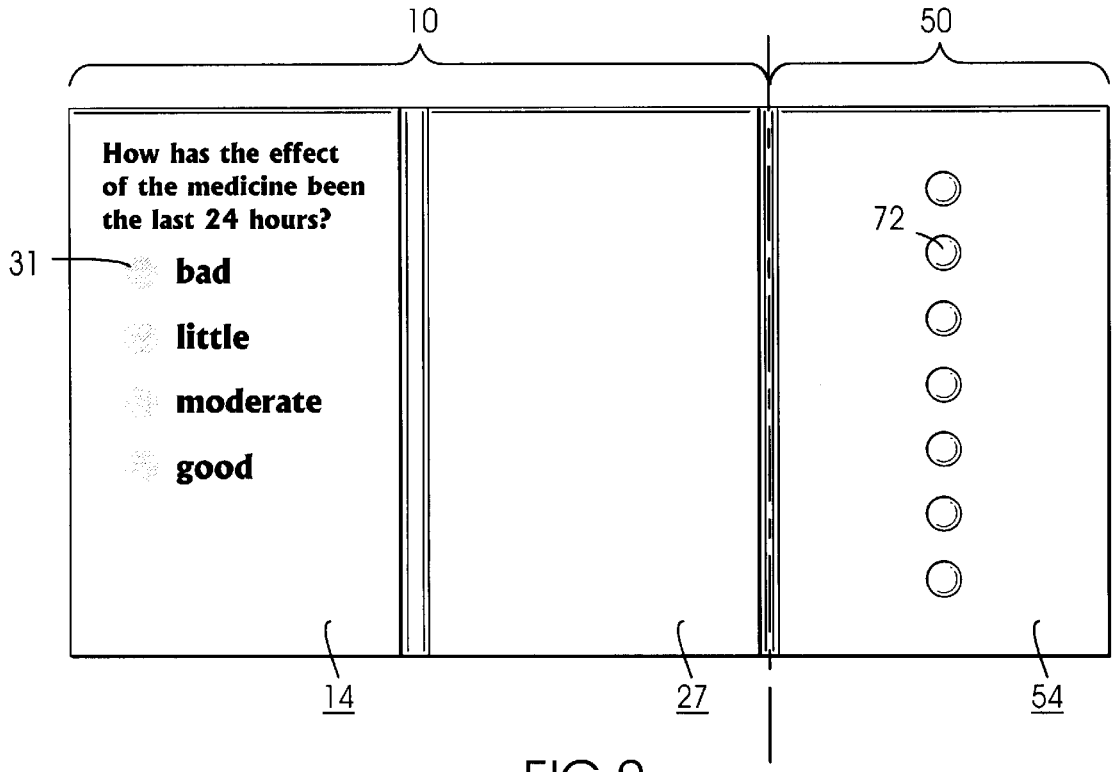
FIG. 2 shows the form in FIG. 1 in a sealed, unfolded condition.

A pharmaceutical package 50 is also shown in FIG. 1 and FIG. 2 attached in one piece with the response form 10. In this case the pharmaceutical package is of the registering type described in Swedish patent document 9700582-1, and will thus only be briefly described here.

The pharmaceutical package 50 consists of two sheets or flap sections 54, 56 between which can be placed a blister package 70 with blisters 72 that, when the package is in the folded up state (FIG. 2), protrude through openings 58 in the flap section 54. Conducting loops 58 of the conducting circuit 26 pass through flap section 56 from the contacts 36 to a withdrawal region for the medicines in the blisters 72. At every withdrawal region there is a cover 62 which can be torn away, over which a conductor 60 of the loop 58 passes, so that when a tablet is pressed out of the blister package 70, the associated cover 62 is also torn away, whereby a breakage occurs in the part of the conductor 60 that passes through the cover, whereby the withdrawal is registered in the electronic unit 40.

A pharmaceutical package integrated with a response form 10 can, however, also take other forms. In box-shaped or cylindrically formed packages, the response form can be arranged on a side or a surface of the package, or as a sheet-formed tab attached to the package (not shown).

Although the invention has been described above together with a pharmaceutical package, there are many other fields of application in which it is necessary to register events, to verify the authenticity, and in some cases to register the time of an event. For example, the response form can be used for market surveys, tickets and despatched items such as letters and packages.

What is claimed is:

1. A response form (10) containing an input means that on manual influence is capable of switching an electrical circuit (26) connected to an electronic unit (40) incorporated into the response form for registration of the said influence, characterised in that:

the response form (10) is formed from a disposable sheet material (12);

the circuit (26) is printed onto one side (16) of the disposable material; and in that said means of input is chosen from a group of input means consisting of circuit makers (30, 32) visually marked on an outer face of the sheet material and arranged to form electrical connections with an interrupted loop (28) of the electrical circuit (26) when influenced by local pressing together of inner faces (14,16) of the sheet material that are arranged at a distance from and facing each other; and circuit breakers (33) visually marked on portions (13) of the disposable material (12) arranged to cause an electrical interruption in a loop (29) of the electrical circuit when influenced by at least partial removal of the loop from the disposable material (12).

2. The response form according to claim 1, characterised in that it is arranged in such a way as to form part of a pharmaceutical package (50).

3. The response form according to claim 2, characterised in that the pharmaceutical package is a package that registers withdrawals (50) and that the electronic unit (40) is common to the package (50) and the response form (10).

4. The response form according to claim 1, characterised in that the circuit maker includes an electrically conducting surface (32) on an inside surface (14) and an interrupted conducting section (30) of the loop on the inner surface opposite to it (16) of the disposable material (12), so that the conducting surface (32) makes electrical contact across the interrupted loop (28) when the circuit maker is pressed together.

5. The response form according to claim 4, characterised by an insulating layer (24) arranged between the said inner surfaces (14, 16), which at the circuit maker includes openings (34) in order to keep the conducting surface (32)

separate from the interrupted conducting section (30) when the circuit maker is not pressed.

6. The response form according to claim 5, characterised in that the insulating layer (24) includes double-sided adhesive tape (24) arranged to seal the response form (10).

7. The response form according to claim 1, characterised in that the circuit breaker includes a tab (13) that can be detached from the sheet material (12) along a perforated tear line (35).

8. The response form according to claim 1, characterised in that the electrical circuit includes an electrically conducting layer (26) printed onto the disposable material.

9. The response form according to claim 1, characterised in that an electrically conducting tape is arranged to attach contact elements (36) of the electrical circuit (26) and the electronic unit (40) to each other.

10. The response form according to claim 1, characterised in that several means of input (13, 33, 30, 32) are arranged at an input field of the disposable material (12).

11. The response form according to claim 1, characterised in that the electrical circuit (26) in addition is arranged to function as an aerial for a transmitter in the electronic unit.

* * * * *